United States Patent [19]

Goldstein

[11] 3,934,765

[45] Jan. 27, 1976

[54] DEVICE FOR MASS PRODUCTION GARMENT STEAMING

[76] Inventor: Mihai Goldstein, 7239 Bergen Court, Brooklyn, N.Y. 11234

[22] Filed: Aug. 20, 1974

[21] Appl. No.: 499,001

[52] U.S. Cl. ..... 223/70

[51] Int. Cl.[2] ..... A41H 5/00

[58] Field of Search ..... 223/69, 70, 51, 52, 71–74, 223/76–79; 38/5, 18–22

[56] References Cited

UNITED STATES PATENTS

| | | | |
|---|---|---|---|
| 2,457,476 | 12/1948 | Kaplan | 223/70 |
| 2,493,864 | 1/1950 | Forman | 223/70 |
| 2,728,129 | 12/1955 | Koffman et al. | 223/51 X |
| 2,990,984 | 7/1961 | Fiduccia | 223/69 |
| 3,118,579 | 1/1964 | Cerami | 223/70 |
| 3,270,926 | 9/1966 | Machota | 223/70 |
| 3,815,795 | 6/1974 | Goldstein | 223/70 |

*Primary Examiner*—Geo. V. Larkin
*Attorney, Agent, or Firm*—Carl Miller

[57] ABSTRACT

An improved device for holding at least several garments during a garment steaming operation so that a large number of garments are more quickly processed through a steaming operation; the device including a bar assembly that is pivotable at a front of a steam table and which carries several sets of novel holding clamps which support garment wire forms on which the garments are stretched flat for pivoting against the steam table surface.

1 Claim, 8 Drawing Figures

DEVICE FOR MASS PRODUCTION GARMENT STEAMING

This invention relates generally to garment steaming machinery, and is an improvement on applicant's U.S. Pat. No. 3,815,795 on a Device For Mass Production Garment Steaming.

A principle object of the present invention is to provide an improved device mountable on a garment steaming table and which permits steaming several garments at one time so that a large number of garments can be quickly processed, and wherein the device include the feature of being more versatile in adjustability than heretofore.

Another object is to provide an improved device for garment steaming that is ideal accordingly for a garment mass production industry, and which is made of less parts than heretofore.

Still another object is to provide an improved device for mass production garment steaming which does not have any projecting components upon which a garment or work gets hung up while being fitted upon or removed from a wire form of the machine.

Other objects are to provide an improved device for mass production garment steaming which is simple in design, inexpensive to manufacture, rugged in construction, easy to use and efficient in operation.

These and other objects will be readily apparent upon a study of the following specification and the accompanying drawing wherein.

Figures 1, 2, 3, 4, 5, 6, 7, 8:
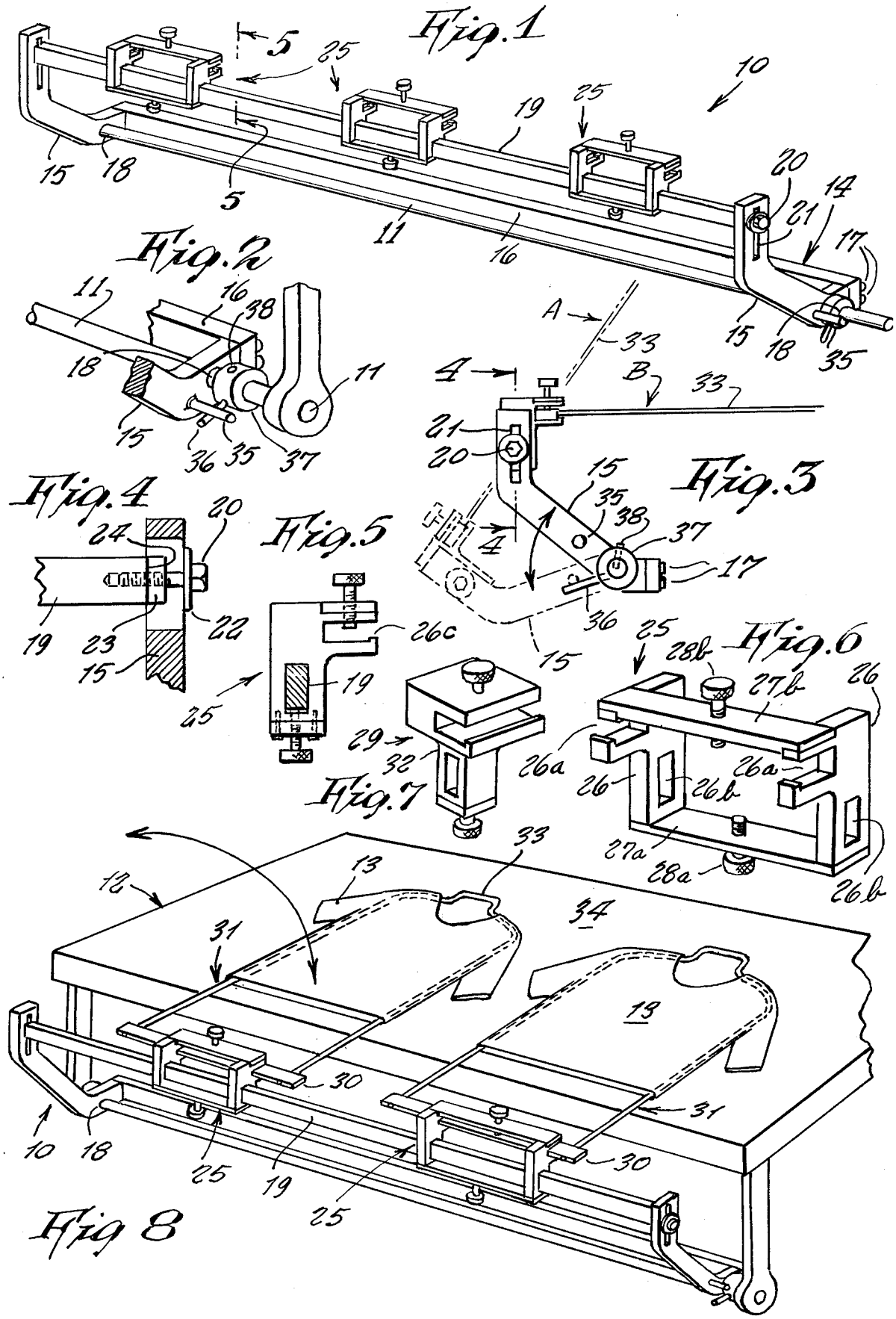
FIG. 1 is a perspective view of the invention.
FIG. 2 is an enlarged detail thereof.
FIG. 3 is an end view.
FIG. 4 is a cross section on line 4—4 of FIG. 3.
FIG. 5 is a cross section on line 5—5 of FIG. 1.
FIG. 6 is a perspective view of one design of a clamp used in the present invention.
FIG. 7 is a perspective view of another design of clamp that may be used in the invention.
FIG. 8 shows the invention mounted on a pressing table.

Referring now to the drawing in greater detail, the reference numeral 10 represents an improved device for mass production garment steaming according to the present invention wherein the same is pivotally mountable upon a cylindrical, stationary shaft 11 located along a front side of a steam table 12 that is used to steam garments 13 in a mass production operation.

In the present invention, the improved device 10 includes rigid U-shaped frame 14 consisting of a pair of parallel, angled arms or levers 15 fixedly secured upon opposite ends of an interconnecting bar 16 by means of screws 17. The levers 15 each include an opening 18, the openings 18 being axially aligned with each other so that the shaft 11 extends therethrough. The frame 14 adjustably supports a clamp support bar 19 by means of a mounting screw 20, threading engaged in each end of the bar, being inserted first through a slot 21 in each lever 15, so that the position of the screw along the slot can be varied before screw tightening. Thus the radial distance of the bar 19 and the axis of shaft 11 about which it pivots is adjustable. A washer 22 is positioned against the head of the screw and bears against the outer face of each lever 15. It is to be noted that the opposite ends of the bar 19 include narrow terminal portions 23 that extend inside the slots 21 so to prevent rotation of the bar 19 respective to the levers 15. A shoulder 24 thus formed near each end of the bar 19 accordingly, bears against the inner face of each lever 15.

Several clamps 25 may be removably mounted along the clamp support bar as shown in FIGS. 1 and 8. Each clamp 25 consists of parallel, spaced apart bars 26 interconnected by plates 27*a* and 27*b*. A pair of jaws in each bar 26 form a mouth 26*a* therebetween. Each bar also includes a slot 26*b* through which the bar 19 is receivable, and each clamp 25 is securable in stationary position along the bar 19 by means of a single thumb screw 28*a*. The clamp 25 is designed to hold a garment supporting form shown in FIG. 8 by means of a single thumb screw 28*b*. Thus the employment of only two single screws in retaining the clamp and the garment supporting form reduces the hazard of numerous projections that might otherwise get hung up on the garments that are to be pressed, particularly at such time as they are being fitted on the form or being pulled off therefrom.

In a modified design, a clamp 29, shown in FIG. 7, is employed when the garment supporting frame is not as wide, and wherein a single block 32 is used in its construction instead of the bars 26 and plates 27*a* and 27*b*.

In each clamp 25 or 29, the mouth 26*a* is designed to grasp a bar 30 of the garment supporting form 31 and hold the same by means of the thumb screw 28*b;* each mouth additionally having a projecting spur 26*c* that prevents the bar 30 to slide out of the mouth in case the thumb screw 28*b* is not turned down sufficiently hard enough. Thus even as the thumb screw is loosely held against the bar 30, the bar will not fall out, so that the spur serves as a safety feature.

The garment supporting form 31 also includes a wire form 33 shaped to the size and style of a particular garment that is to be fitted thereupon, in order that the garment is in a flat position while being steamed.

In use, the frame 15 is pivotable about shaft 11 so that the flat wire forms 33 are pivotable between the position A and B (shown by dotted and solid lines respectively in FIG. 3) so that when tilted upwardly, a garment can be fitted thereupon or removed, while when in a horizontal position, the garment is against the top surface 34 of the steam table so that steam from the table is blown through the garment and then subsequently vacuum-drawn away therefrom so to steamed garment is left dry.

The tilted position A occurs when a sideward projection 35 on each lever 15 abuts against a pin 36 extending from a collar 37 locked on shaft 11 by a set screw 38. The tilt angle can be selectively adjusted by loosening the set screw, rotating the collar as wished and there locking the set screw against rotating.

While various changes may be made in the detail construction, it is understood that such changes will be within the spirit and scope of the present invention as is defined by the appended claim.

What is claimed is:

1. In a device for garment steaming, the combination of a steam table having a top surface, a stationary horizontal shaft supported by stanchions in spaced relation below a forward edge of said table, a U-shaped frame pivotally mounted on said shaft, said U-shaped frame comprising a pair of parallel, spaced apart levers and a bar between one end thereof, an opening in each lever near said end, said openings being axially aligned and receiving said shaft, an elongated slot near an opposite end of each said lever, a clamp support bar between said slots being adjustably supported therein respective to said shaft, a plurality of clamps adjustably mounted along said clamp support bar, a flat garment supporting form being removably held by each said clamp, said garment supporting clamps in one pivotal position of said U-shaped frame resting flat against said steam table upper surface, and adjustable stop means for limiting a pivotal travel of said U-shaped frame for a selective upward position of said garment supporting form, said adjustable stop means comprises a projection on a side of each said lever, said projection being axially parallel to said shaft, and a pair of collars rotationally adjustably mounted on said shaft, each collar having a radially extending pin, said pin extending into a travel path of one of said projections; said clamp supporting bar and said bar which is between the one ends of said levers being parallel to said stationary shaft which is supported by said stanchions, said levers being at right angle to both said bars and said stationary shaft;

each said clamp having a slot for receiving said clamp support bar, and also having a mouth for receiving said garment supporting form, a single thumb screw on each said clamp for securement of said clamp on said clamp supporting bar, another single thumb screw also on each said clamp for securement of one said garment supporting form on said clamp; said mouth being formed between a pair of jaws one of which has a spur at its end projecting into said mouth and in a direction toward the other said jaw for abutting against said garment supporting form positioned in an inner end of said mouth, certain of said clamps each comprising a pair of parallel, spaced bars each of which contains one said slot and one said mouth and said pair of bars being held together by a pair of interconnecting plates, while others of said clamps each comprise a single block containing said slot and said mouth.

* * * * *